US006048124A

United States Patent [19]

Kawabe

[11] Patent Number: 6,048,124

[45] Date of Patent: Apr. 11, 2000

[54] WRITING IMPLEMENT CLIP AND WRITING IMPLEMENT EQUIPPED WITH THE WRITING IMPLEMENT CLIP

[75] Inventor: Ryu Kawabe, Tama, Japan

[73] Assignee: Leadworks International Inc., Tokyo, Japan

[21] Appl. No.: 09/199,124

[22] Filed: Nov. 24, 1998

[30] Foreign Application Priority Data

Nov. 28, 1997 [JP] Japan ..... 9-327661

[51] Int. Cl.[7] ..... B43K 5/18

[52] U.S. Cl. ..... 401/243; 401/195

[58] Field of Search ..... 401/131, 52, 185; 24/11 R, 10 R; 211/69.1

[56] References Cited

U.S. PATENT DOCUMENTS

| | | | |
|---|---|---|---|
| D. 149,897 | 6/1948 | McFadyen | 401/131 X |
| 2,297,806 | 10/1942 | Smith | 401/131 X |
| 2,644,212 | 7/1953 | Markowitz | 24/10 R X |
| 2,913,789 | 11/1959 | Loredo | 401/131 X |
| 3,051,130 | 8/1962 | Morris | 24/11 R X |
| 4,674,298 | 6/1987 | Wimmershoff-Caplan | 24/10 R X |

*Primary Examiner*—David J. Walczak
*Attorney, Agent, or Firm*—Koda & Androlia

[57] ABSTRACT

A writing implement having a movable attachment body at the end of a connecting member that is fastened to the writing implement. The writing implement is further provided with a fixed attachment body. Either the movable attachment body or the fixed attachment body, or both, are made of magnets so that they are magnetically attached to each other, thus holding the writing implement in, for instance, a pocket.

12 Claims, 6 Drawing Sheets

WRITING IMPLEMENT CLIP AND WRITING IMPLEMENT EQUIPPED WITH THE WRITING IMPLEMENT CLIP

BACKGROUND OF THE INVENTION

1. Field of the Invention

The present invention relates to a clip for a writing implement which holds the writing implement in, for instance, a pocket of a shirt and also to a writing implement equipped with such a clip.

2. Prior Art

The caps of writing implements such as fountain pens, ball point pens, etc. are equipped with clips which hold the writing implements in place, primarily by clipping onto the pocket of a garment.

Such clips are ordinarily made of metal and utilize elasticity of the metal to hold the writing implement by clamping the material of the pocket between the clip end and the cap.

When such a clip is used for a long period of time on a garment made of a relatively thick material such as a sack-cloth overcoat, etc., the spring elasticity may deteriorate, and the clip is no longer able to function to hold the writing implement in a pocket. Furthermore, when a relaxed clip is used in the pocket of a thin garment such as a dress shirt, etc., the clip is unable to hold the writing implement in place in a proper manner. In addition, the garments may be damaged as a result of being clamped by such a clip.

Furthermore, clips made of plastic are also known; however, such plastic clips can be easily broken.

Writing implements such as retractable ball point pens, mechanical pencils, etc. are also equipped with a cap that has a clip; and in these writing implements, the situation is substantially the same.

The problems described above generally arise from the fact that the holding function of the clip depends on a rigid spring elasticity.

SUMMARY OF THE INVENTION

Accordingly, the inventor of the present patent application has reached an idea that an effect similar to that of conventional clips could be achieved by a magnetic force.

The inventor conducted an on-line prior art search using a particular search mode but could not find any art that is relevant to the present invention.

Thus, the object of the present invention is to provide a writing implement clip which uses a magnetic attachment; and with the use of a magnetic attachment, the holding capability of clip of the present invention does not deteriorate even with a long-term use, and the clip does not damage the material of the clothing.

It is another object of the present invention to provide a writing implement clip which gives consideration to convenience during the use of the writing implement.

It is still another object of the present invention to enhance the ornamental or amusement-related properties of a writing implement.

It is further an object of the present invention to provide a writing implement which is equipped with a clip that uses a magnetic attachment, shows no deterioration in holding capacity even in a long-term use, and does not damage the material of clothing.

The above objects are accomplished by a unique structure for a writing implement clip that comprises: a flexible connecting member fastened at one end thereof to the writing implement, a movable attachment body provided at another end of the connecting member, and a fixed attachment body provided on the writing implement; and either the movable attachment body or the fixed attachment body, or both, are formed from a magnet, so that the movable attachment body and fixed attachment body are magnetically attracted to each other and hold the writing implement in place.

In this structure, the writing implement may have a recess so as to accommodate the movable attachment body therein, and the movable attachment body may be provided with an ornamentation thereon.

DETAILED DESCRIPTION OF THE PREFERRED EMBODIMENTS

Figure 1:
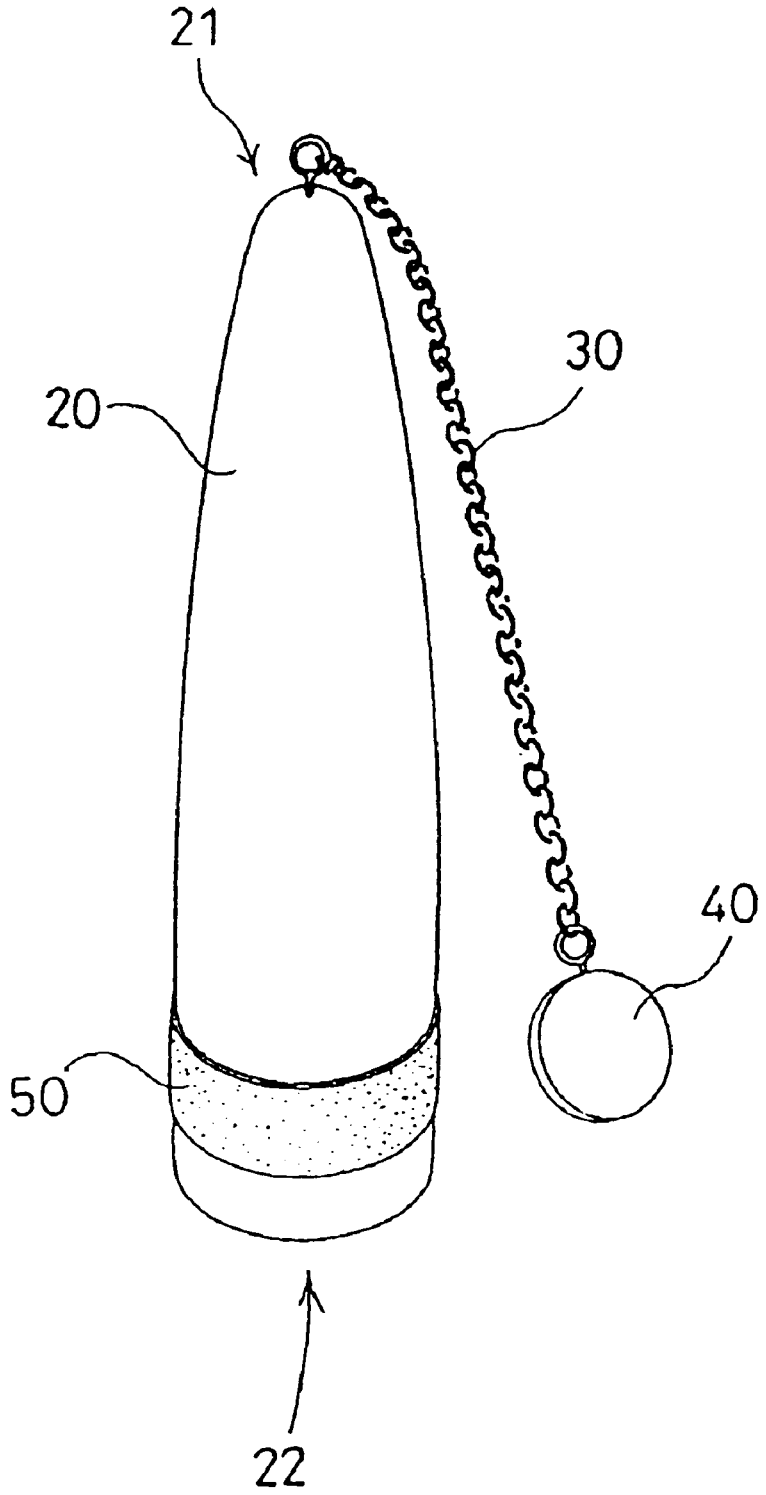
FIG. 1 is a perspective view of a first embodiment of the writing implement clip according to the present invention.

As seen from FIG. 1, the writing implement clip of the present invention is characterized in that one end of a flexible connecting member 30 is fastened to the end of a writing implement 10, particularly to the end of a cap 20 of the writing implement 10, and a movable attachment body 40 is attached to the free end of this connecting member 30. A fixed attachment body 50 is provided on the surface of the cap 20, and either the movable attachment body 40 or the fixed attachment body 50, or both, are made from magnet, so that the movable attachment body 40 and fixed attachment body 50 are attached to each other by a magnetic force.

In the above, the term "flexible" refers to the nature of the connecting member which can freely move, and which is free to bend and recover from bending, such as a cord, chain, etc.

The term "connecting member" refers to an element which connects the writing implement 10 and movable attachment body 40. This connecting member is made from a material which is "flexible" as described above.

In addition, the term "movable attachment body" is a small piece of magnetic material or magnet.

Furthermore, the term "fixed attachment body" refers to a magnet or magnetic material which is provided on the surface of the writing implement 10 or the cap 20 thereof, and it can be in a plate form, band form or annular form.

The combination in terms of materials for the above-described movable attachment body 40 and fixed attachment body 50 may be any of the following three combinations:

(a) A combination of the movable attachment body 40 consisting of a magnetic material and the fixed attachment body 50 consisting of a magnet.

(b) A combination of the movable attachment body 40 consisting of a magnet and the fixed attachment body 50 consisting of a magnetic material.

(c) A combination in which both the movable attachment body 40 and the fixed attachment body 50 consist of magnets.

In the combination (c), it is necessary that the surfaces of the movable attachment body 40 and fixed attachment body 50 that are magnetically attracted each other be opposite poles.

In the above, the term "magnetic material" refers to a material that is capable of being attracted by magnets and therefore is not a magnet.

Figure 2:
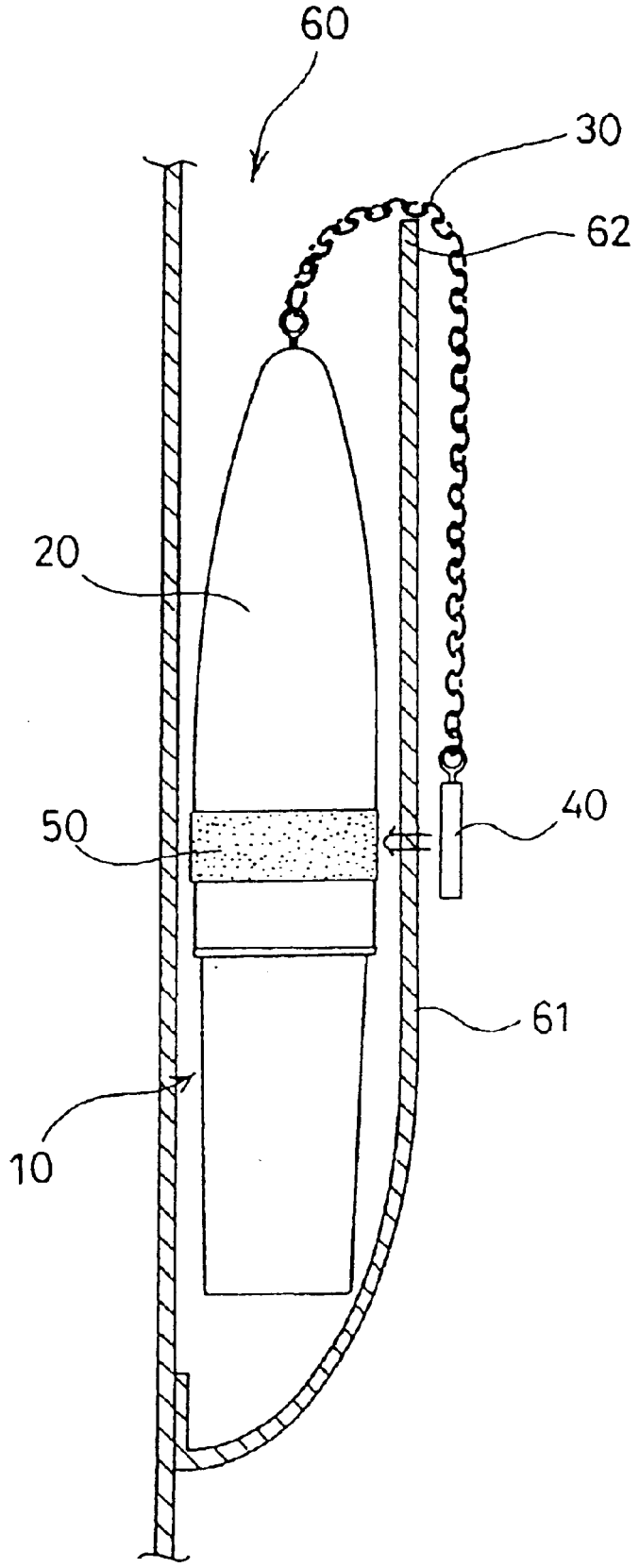
FIG. 2 illustrates a use of the clip of the first embodiment of the present invention with the pocket of a clothing shown in cross-section.

The clip of the present invention is used in the following manner:

When the writing implement 10 on which the above-described clip is mounted is put in, for instance, a breast pocket 60, as shown in FIG. 2, the connecting member 30 is allowed to hang down on the outside of the pocket 60. Accordingly, the movable attachment body 40 which is fastened to the tip end of the connecting member 30 magnetically attaches itself to the fixed attachment body 50 of the writing implement 10 through the material 61 of the pocket 60 as shown by an arrow. Thus, substantially the same effect as in a conventional metal or plastic clip is obtained, and the writing implement 10 is held in place in the pocket 60 by the fixed attachment body 50 and movable attachment body 40 which are attached to each other.

Figure 3:
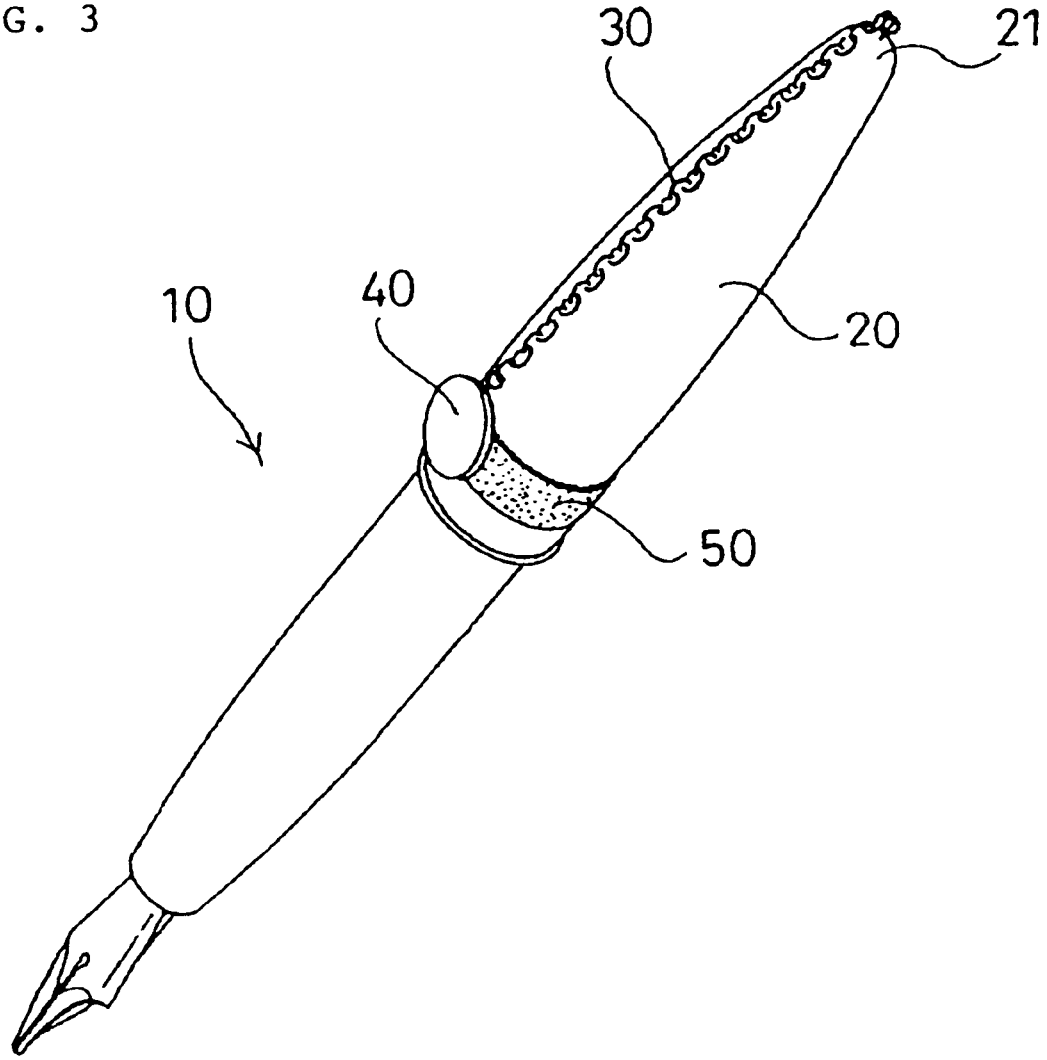
FIG. 3 illustrates another use of the clip of the first embodiment of the present invention.
Figure 5:
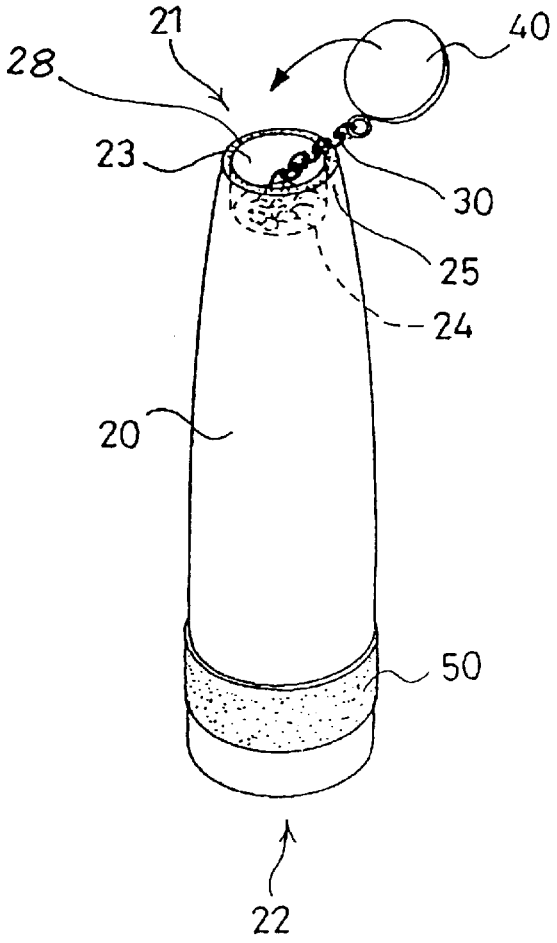
FIG. 5 is a perspective of the second embodiment of the writing implement clip according to the present invention.

In the writing implement clip of the present invention, as shown in FIG. 3, the movable attachment body 40 may be attached to the fixed attachment body 50 during writing; however, this might interfere with writing. So as to avoid such an interference, the connecting member 30 can be brought into a recess 23 formed in the tip end of the cap 20 as shown in FIG. 5.

It is even more convenient for writing if the movable attachment body 40 is magnetically attached to the edge that surrounds the recess 23 of the cap 20. With this structure, the movable attachment body 40 is assuredly prevented from slipping out of the cap 20.

It is further possible to provide the movable attachment body 40 and connecting member 30 with an ornamentation thereon.

In other words, by forming the movable attachment body 40 in the shape of, for example, a comic book character, it is possible to enhance the ornamental or amusement value of the writing implement 10.

Embodiments of the present invention will be described in further detail below with reference to the accompanying drawings.

FIGS. 1 through 4 illustrate a first embodiment of the present invention.

In this first embodiment, a fixed attachment body 50 formed from a magnet in a band form is attached to the surface of the cap 20 near the bottom opening 22. The cap 20 is not provided with a conventional clip that basically works with its elasticity.

A connecting member 30, which is a chain, is fastened at one end thereof to the closed tip end 21 of the cap 20, the tip end 21 being at the opposite end from the opening 22. A movable attachment body 40 made of steel is attached to another end of the connecting member 30. The length of the connecting member 30 is set to be greater than the distance between the tip end 21 of the cap 20 and the fixed attachment body 50.

With this structure, the movable attachment body 40 can be magnetically attached to the fixed attachment body 50.

In use, as shown in FIG. 2, a writing implement 10 with the cap 20 (provided with the fixed attachment body 50, connecting member 30 and movable attachment body 40) thereon is inserted into a breast pocket 60. When the writing implement 10 is put in the pocket, the movable attachment body 40 is detached from the fixed attachment body 50 and is allowed to hang down on the outside of the pocket 60 via the connecting member 30.

Afterward, the movable attachment body 40 is brought to and magnetically attached to the fixed attachment body 50 with the material 61 of the pocket 60 in between. Accordingly, with the connecting member 30 suspended from the upper edge 62 of the pocket 60, the writing implement 10 can be held in the pocket 60.

In other words, the writing implement 10 can easily be held in the breast pocket 60, etc. by magnetic attachment. Even with repeated use, there is no deterioration of the holding capability as in a conventional clip.

When the writing implement 10 is used, the movable attachment body 40 is detached from the fixed attachment body 50, and the writing implement 10 is taken out of the pocket 60. During writing, the movable attachment body 40 may be attached to the fixed attachment body 50 as shown in FIG. 3, so that the movable attachment body 40 will not interfere with writing.

In the embodiment described above, the movable attachment body 40 is made of steel; however, it is also possible to form this movable attachment body 40 from some other magnetic material. Alternatively, it would also be possible to form the movable attachment body 40 from magnets. In this case, however, it is necessary that the surfaces of the movable attachment body 40 and fixed attachment body 50 that are magnetically attached to each other be of opposite poles. For example, if the surface of the fixed attachment body 50 is an N pole, then the attachment surface of the movable attachment body 40 must be an S pole.

Figure 4:
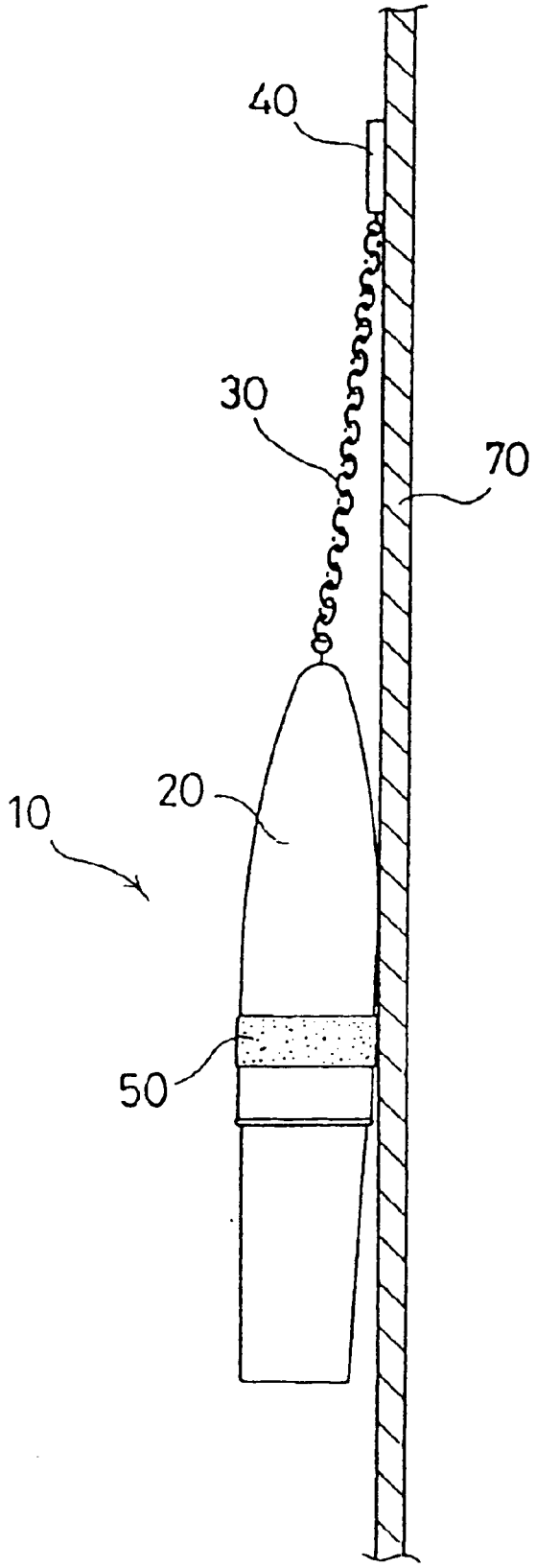
FIG. 4 illustrates another use of the clip of the first embodiment of the present invention on a white board which is shown in cross-section.

If the movable attachment body 40 is a magnet, then, as shown in FIG. 4, the movable attachment body 40 can be attached to a white board 70, so that the writing implement 10 capped with the cap 20 that has the magnetic movable attachment body 40 is held suspended on the white board 70.

The fixed attachment body 50 may be formed in band form so as to surround the entire circumference of the cap 20 or may be formed in a preferred shape such as round, square, rectangular so as to be mounted on only a portion of the surface of the cap 20. Furthermore, if the movable attachment body 40 is a magnet, then the fixed attachment body 50 is formed from a magnetic material.

Besides being formed from a chain, the connecting member 30 may be formed from a cord, coil, etc. and may be formed from any desired material.

Furthermore, in the above embodiment, one end of the connecting member 30 is fastened to a point that is closer to the (upper) tip end 21 of the cap 20 than the fixed attachment body 50. However, the connecting member 30 may be fastened to a point located at the same position as the fixed attachment body 50 or to a point that is closer to the opening 22 than the fixed attachment body 50.

FIG. 5 illustrates a second embodiment of the present invention.

In this second embodiment, the connecting member 30 is designed so as to be accommodated inside the cap 20.

More specifically, a recess 23 is formed in the tip end of the cap 20, and one end of the connecting member 30 is fastened to the bottom 24 of this recess 23. Furthermore, an annular form magnet 28 is provided on the rim 25 that surrounds the recess 23.

Accordingly, during writing, the connecting member 30 can be put in the recess 23; in addition, since the movable attachment body 40 is magnetically attached to the magnet 28 of the rim 25 that surrounds the recess 23, the movable attachment body 40 can be used as a cover for the recess 23.

Thus, writing can be performed more comfortably, without any interference from the connecting member 30 or movable attachment body 40.

In addition, it is also possible to install, for example, a reel inside the cap 20, and the connecting member 30 is taken up on this reel.

Figure 6:
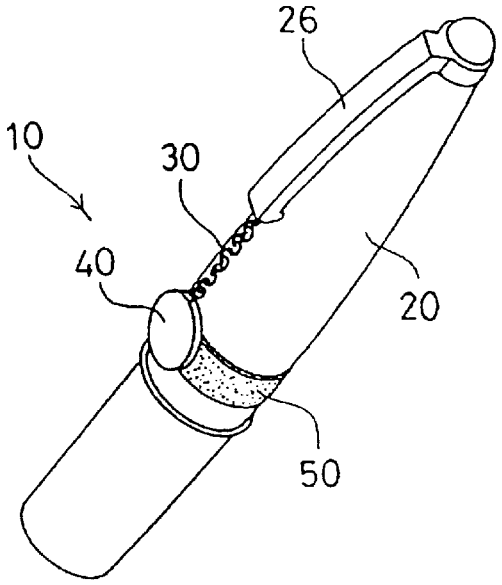
FIG. 6 is a perspective view of the third embodiment of the writing implement according to the present invention.

FIG. 6 illustrates a third embodiment of the present invention.

In this embodiment, a projection 26 similar to a conventional clip is disposed in the vicinity of the tip end 21 of the cap 20, and one end of a connecting member 30 is fastened to the (lower) end of this projection 26. A movable attachment body 40 is fastened to the free end of this connecting member 30.

The same effect as in the first embodiment is obtained by this third embodiment.

Figure 7:
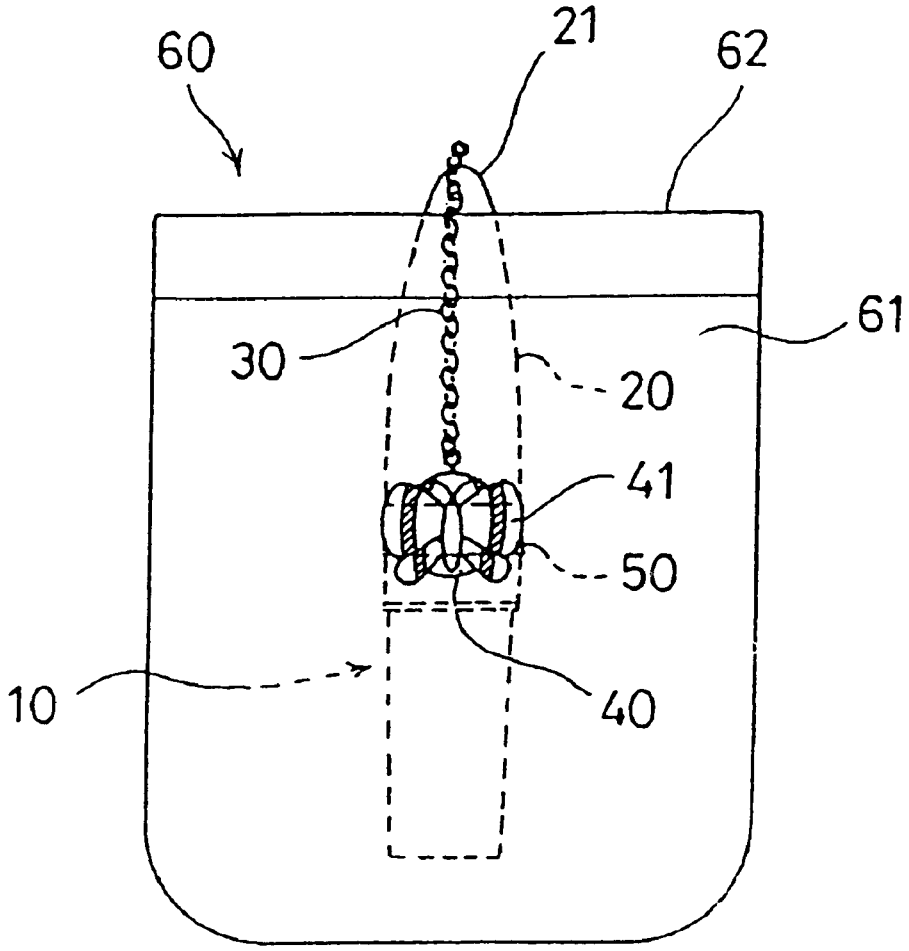
FIG. 7 is a front view of the fourth embodiment of the writing implement according to the present invention.

FIG. 7 illustrates a fourth embodiment of the present invention.

In this embodiment, an ornamental body 41 is mounted on one side of the movable attachment body 40 which is the opposite side from the side that faces the fixed attachment body 50. In other words, the ornamental body 41 is provided on the side that is visible from the outside when the writing implement 10 is held in a pocket by the movable attachment body 40.

For example, this ornamental body 41 may take the form of a comic book character, badge, etc., thus enhancing the ornamental value or amusement value of the writing implement 10.

In FIGS. 1 through 7, the fixed attachment body 50 is shown clearly for the purposes of graphic illustration and a better understanding; however, it is also possible to paint or plate the fixed attachment body 50 so as to show as in the same manner as other portions of the cap 20, so that the fixed attachment body 50 is not conspicuous in terms of external appearance. In this way, the design of the writing implement can be diversified.

The present invention can be applied to the caps of cosmetic products (which are used as writing implements on the human body), such as lipstick, eye liner, eyebrow pencils, etc.

In addition, the above description is made in regards to writing implements equipped with a cap; however, the present invention can be applied to a writing implement which has no cap but is able to be provided with clips, such as retractable ball point pens, mechanical pencils, etc. In such a case, the flexible connecting member 30 having the movable attachment body 40 is attached to the opposite end from where, for instance, the ball point is provided, and the fixed attachment body 50 is provided on the body of the writing implement.

As seen from the above, according to the present invention, a writing implement can be held in a pocket, etc. by magnetic attachment in the same manner as with a conventional clip. In addition, the present invention can provide a writing implement clip in which the holding force does not deteriorate even with long time use and which does not damage clothing.

In addition, since the connecting member can be accommodated inside the writing implement during writing, the connecting member does not interfere with writing.

Also, the ornamental or amusement value of the writing implement can be enhanced.

I claim:

1. A clip for a writing implement, said clip comprising:

a flexible connecting member adapted to be fastened at one end thereof to a writing implement, said flexible connecting member extending longitudinally of said writing implement;

a movable attachment body fastened to another end of said connecting member; and a fixed attachment body adapted to be provided on a portion of a surface of said writing implement at a predetermined distance from said one end, wherein at least one of said movable attachment body and said fixed attachment body is a magnet, so that said movable attachment body and fixed attachment body are attached to each other by magnetic force.

2. A clip for a writing implement according to claim 1, characterized in that said writing implement is provided with a recess so as to accommodate therein said flexible connecting member.

3. A clip for a writing implement according to claim 2, characterized in that at least said movable attachment body is provided with ornamentation.

4. A clip for a writing implement according to claim 1, characterized in that at least said movable attachment body is provided with ornamentation.

5. A writing implement comprising:

a flexible connecting member adapted to be fastened at one end thereof to said writing implement, said flexible connecting member extending longitudinally of said writing implement;

a movable attachment body fastened to another end of said connecting member; and a fixed attachment body adapted to be provided on a portion of a surface of said writing implement at a predetermined distance from said one end, wherein at least one of said movable attachment body and said fixed attachment body is a magnet so that said movable attachment body and fixed attachment body are attached to each other by magnetic force.

6. A writing implement according to claim 5, characterized in that said writing implement is provide with a recess so as to accommodate therein said flexible connecting member.

7. A writing implement according to claim 6, characterized in that at least said movable attachment body is provided with ornamentation.

8. A writing implement according to claim 5, characterized in that at least said movable attachment body is provided with ornamentation.

9. A cap for a writing implement comprising:

a flexible connecting member adapted to be fixed at one end thereof to a closed end of said cap and extending longitudinally of said cap, said flexible connecting member having at another end thereof a movable attachment body; and a fixed attachment body adapted to be provided on a portion of an outer surface of said cap at a predetermined distance from said closed end;

wherein said movable attachment body and said fixed attachment body are made of materials which are magnetically attracted to each other.

10. A cap according to claim 9, further comprising a recess formed in said closed end of said cap so as to accommodate therein said flexible connecting member.

11. A cap according to claim 10, wherein an area surrounding said recess is magnetic so as to magnetically attach said movable attachment body thereon.

12. A clip according to claim 9, wherein one side of said movable attachment body is provided with an ornamentation.

* * * * *